US005347069A

United States Patent [19]

Sundar

[11] Patent Number: 5,347,069

[45] Date of Patent: Sep. 13, 1994

[54] TREATING OILY WASTES

[75] Inventor: Parameshwaran S. Sundar, Fairfax, Calif.

[73] Assignee: Chevron Research and Technology Company, San Francisco, Calif.

[21] Appl. No.: 967,352

[22] Filed: Oct. 27, 1992

[51] Int. Cl.[5] ..... C10G 17/10

[52] U.S. Cl. ..... 588/252; 208/13; 134/7; 405/128

[58] Field of Search ..... 405/128, 129, 131; 210/747, 751, 748; 134/7; 588/249, 252; 208/13

[56] References Cited

U.S. PATENT DOCUMENTS

| | | | |
|---|---|---|---|
| 3,043,771 | 7/1962 | Bloch | 208/13 X |
| 4,144,162 | 3/1979 | Edgar et al. | 208/13 |
| 4,274,880 | 6/1981 | Chappel | 106/90 |
| 4,514,307 | 4/1985 | Chestnut et al. | 210/751 |
| 4,775,457 | 10/1988 | Beer et al. | 208/13 |
| 4,867,755 | 9/1989 | Majid et al. | 44/604 |
| 4,931,161 | 6/1990 | Sundar | 208/13 |
| 5,078,593 | 1/1992 | Schreiber et al. | 208/13 X |
| 5,100,455 | 3/1992 | Pinckard et al. | 134/7 X |
| 5,114,593 | 5/1992 | Diaz | 134/7 |
| 5,163,496 | 11/1992 | Jacob | 134/7 X |

FOREIGN PATENT DOCUMENTS 3643345 6/1988 Fed. Rep. of Germany .

*Primary Examiner*—Dennis L. Taylor
*Attorney, Agent, or Firm*—W. K. Turner; M. L. Davis

[57] ABSTRACT

Disclosed is a process for treating oily wastes, which have a predominantly liquid phase, by mixing the oily waste with a granulating medium under turbulent flow conditions. The process comprises mixing the oily waste with a granulating medium under such conditions, wherein granules are formed having an attrition index of less than about 10 percent and a filtration index of greater than 0.20 gallons per minute per square foot. The contaminating hydrocarbons may then be removed by contacting the granules with a solvent capable of removing at least a portion of the contaminating hydrocarbons. The granules are then recovered by means known in the art.

18 Claims, No Drawings

TREATING OILY WASTES

BACKGROUND OF THE INVENTION

1. Field of the Invention

The present invention relates to a method for treating oily wastes by forming the waste into granules. More particularly, the method uses a high speed mixer to form granules of a discrete size, from which a portion of the contaminating hydrocarbons may be removed.

2. Description of Related Art

Treatment of oily waste material and, especially soils and particle fines which have been burdened with oily materials, has been and continues to be a problem. In the past, various methods have been used in an attempt to consolidate or to encapsulate the material prior to further treatment or to disposal of the material.

One method to treat oily wastes is to extract the hydrocarbons from the oily waste with a solvent. An example of a method is disclosed in U.S. Pat. No. 4,931,161, the disclosure of which is incorporated herein by reference, involves adding solids to the oily waste, then granulating the mixture. The granules are then contacted with a solvent to recover the hydrocarbons. The process however, produces granules of varied size and must be crushed and screened for uniformity.

Another method of treating the oily waste is to mix the waste with water containing modifiers under conditions that result in the material forming a slurry. The modifiers enhance the scrubbing effect of the water. However, a major consideration of all washing techniques is the fact that as the particle reject size decreases, handling and cleaning efficiency likewise decreases. This requires the fines to be separated by centrifuges, belt filters, and other costly methods known in the art. Because these fine particles are carried out of the cleaning system relatively early they contain higher amounts of harmful substances and may also constitute more than 30% of the soil being treated.

Another method is to convert the oily waste material to a substantially impermeable, load-bearing construction material. U.S. Pat. No. 4,514,307 provides an example of such a method. According to the '307 patent, waste material is combined with cementitious reactants consisting essentially of lime and fly ash, in the presence of water, to form a mixture in which the relative proportions of the waste material, linde, fly ash, and water are adapted to permit the lime and fly ash to react at atmospheric conditions and thus to form a cementitious matrix in which the waste material is encapsulated.

Still another method of treating oily wastes involves combining the waste with solids and then incinerating the mixture. U.S. Pat. No. 4,775,457 provides an example of such a method. According to the '457 patent crude oil and other heavy hydrocarbon sludges are mixed with adsorbent material, preferably an earth material, such as diatomaceous earth or perlite, and oxidized in an incinerator or calciner to produce gaseous combustion products and a friable solids material which is substantially hydrocarbon free and may be recycled for mixture with the incoming sludge stream or otherwise disposed of in an environmentally acceptable manner.

A disadvantage in using any of the aforementioned processes is that the particle size, to a large degree, is random. Particles may range in size from less than 0.003 to greater than 3 inches. This non-uniformity significantly hinders hydrocarbon removal from the granules in subsequent process steps.

It is, therefore, a principal object of the present invention to provide a method for producing free flowing granules having a discrete size. Preferably, the granules have a particle size of less than about 0.5 millimeters. As used herein, the term "free flowing" is defined as a powder that flows freely with no bridging in the bulk when withdrawn from the bottom of a conical hopper having a 30° included angle.

It is another object of the invention to improve the efficacy of solvent extracting the hydrocarbons from the granules. These and other objects are accomplished by the invention set forth in the description and examples below.

SUMMARY OF THE INVENTION

The present invention is a method for treating oily wastes burdened by one or more contaminating hydrocarbons by forming the waste into granules. The method comprises mixing the oily waste with a granulating medium under turbulent flow conditions, wherein granules are formed having an attrition index of less than about 10 percent and a filtration index of greater than 0.20 gallons per minute per square foot. Optionally, it may be advantageous to remove free liquids froth the oily waste before mixing the waste with the granulating medium.

Among other factors, the present invention is based on the finding that by using a high speed mixer to produce a turbulent flow wherein the oily waste is contacted with a granulating medium, a highly effective means for forming granules is achieved. Surprisingly, the size of the granules is more easily controlled than heretofore known. These granules do not have to be subsequently ground in order to provide a free flowing composition. The granules' size range from about 0.074 millimeters to less than about 0.5 millimeters.

Surprisingly, it has also been found that because of the uniformity of the granules size, solvent extraction efficiency is enhanced. This facilitates handling, reduces costs, increases subsequent oil recovery from the granules, and increases ultimate disposal opportunities.

Accordingly, a preferred overall embodiment of the present invention is provided which comprises: removing free liquids from the oily waste; mixing the oily waste with a granulating medium under turbulent flow conditions, wherein granules are formed having an attrition index of less than about 10 percent and a filtration index of greater than 0.20 gallons per minute per square foot; contacting the granules with a solvent capable of dissolving at least a portion of the contaminating hydrocarbon; and recovering said granules, wherein said granules have a reduced content of contaminating hydrocarbons.

DETAILED DESCRIPTION OF THE PREFERRED EMBODIMENTS

As previously discussed, the present process treats oily wastes so that they may be more easily handled and processed. These oily waste materials typically contain a hydrocarbon, a solid, and water. Optionally, the oily waste have a predominantly liquid phase. Non-limiting examples of oily wastes for use in the method of the invention are API separator sludge, oily soil, tank bottoms, reservoir sludges, API filter cakes, sludge from oily dumps, etc.

The hydrocarbons found in these wastes include a wide range of cyclic and non-cyclic hydrocarbons. These "hydrocarbons" may contain heterocyclic compounds having nitrogen or sulfur atoms, but are loosely referred to as hydrocarbons as they are primarily composed of hydrogen and carbon atoms. Typically, the hydrocarbon fraction of the waste comprises between 2 and 50% of the total waste, more typically between 2 and 20% of the total waste.

The oily waste may contain solids of different sizes. The solids may be from 0.001 inch to 4.0 inch in size. Solids which are between 0.001 and 0.0625 inches are typically called "fines". Solids which are between 0.0625 and 4.0 are easier to separate out by screening. In the present invention, solids can be referred to as: i) feed solids—the solids present in the oily waste or oily sludge which are to be treated in the process of the present invention, and (ii) granulating medium—the solids which are added to the sludge, and (iii) product solids—the solids which are obtained after granulation.

Prior to adding the granulating medium to the oily waste in accordance with the present invention, it may be advantageous to "dewater" the waste if excessive amounts of fluids are present. The "dewatering" step involves reducing the amount of free liquid phase in the waste, and may involve a solid-liquid separation operation such as filtration or centrifugation. The term "free liquid phase" refers to any water and hydrocarbon that does not adhere to the surface of the solids of the feed composition or is not trapped within voids in such solids. Such waste may conveniently be referred to as dewatered waste. It is to be understood that some wastes will initially be available where a dewatering step is not required or desired. If the feed solids are overly dewatered or if the oily waste has a moisture content insufficient for the granulating medium to adhere to the waste, it may be necessary to add small quantities of water during mixing the feed solids with the granulating medium.

As described above, the oily waste is formed into solid granules. It is critical to the process that the granules be formed by mixing the oily waste and the granulating medium under a turbulent flow conditions. Preferably the sludge and granulating medium are mixed using a mixer capable of producing high speed and high shear conditions. The term "high speed and high shear" means that the oily waste and granulating medium inside the mixer exhibit a turbulent flow regime, as opposed to a laminar flow through the mixer. The term "turbulent flow" refers to the motion of the feed solids and granulating medium such that their velocities fluctuate irregularly and in a random manner. It is preferred that the mixer be a horizontal mixing volume with multiple mixing paddles. One such mixer, the Turbulizer®, is commercially available from BEPEX Corporation of Minneapolis, Minn. The process configuration will depend upon the type of oily waste that is being processed. Thus, it may be necessary to vary the internal configuration of the mixer, its operational speed, as well as the feed rates of the oily waste, granulating medium, and, if needed, water into the mixer to obtain the product solids.

The granulating medium comprises a filler and a binder. In forming the granulating medium, the filler and binder are premixed. Preferred amounts of binder are 1 to 100 parts binder per 100 parts of filler; more preferably 5 to 40 parts binder per 100 parts filler; and most preferably 10 to 20 parts binder per 100 parts filler. Preferably, a 1 to 10 mixture of calcium sulfate hemihydrate and limestone is used. All parts and percentages are by weight unless otherwise stated. Apparatus suitable for mixing the binder and filler include ribbon blenders, vertical mixers, concrete mixers, or other similar types of mixing equipment.

Fillers used in the present invention preferably are inert to the feed solids or oil. Not wishing to be bound by any theory, it is believed that the filler increases the solids content of the waste and the added binder assists in holding the mix together. It is believed that the addition of filler solids helps trap fine particles that are otherwise difficult to separate from the liquid phase during a subsequent solvent extraction of the hydrocarbons.

Typical fillers are fly ash; limestone; spent catalysts and catalyst fines; calcium sulfate; gypsum; calcium carbonate; magnesium carbonate; as well as other silicates and carbonates. Preferably limestone is used. Most preferably the limestone is of the "flour" grade or similar consistency. Preferably, enough filler is added to increase the solids content to between 65% and 95% of the total mixture, more preferably between 75% and 90% of the total.

Binders used in the present invention are materials which form an interlocked mass with the filler. To form this mass, it may be necessary to provide water to the binder. The water can be added or present in the waste. It is preferable to add the waste to the granulating medium where water may be added to the filler/binder/-waste mixture to assist in solidification.

Typical binders are cementitious materials such as lime, portland cement, calcium aluminate, Plaster of Paris, anhydrous gypsum, etc. The term, "portland cement", is used to refer to a cementitious material obtained by roasting a mixture of lime and clay and then pulverizing the resulting material. Thus, it typically is a greenish gray powder of basic calcium silicate, calcium aluminate, and calcium ferrites. When mixed with water it solidifies to an artificial rock, similar to portland stone.

From the physical properties of the oily waste, i.e., moisture content, particle sizes, etc. it may be necessary to adjust the amount of oily waste, granulating material, and the amount of time required for mixing to obtain a mixture capable of being formed into discrete particles. Incomplete granulation results in soft granules with poor mechanical strength. Excessive granulation results in hard granules which adversely effect any subsequent solvent extraction step. The amounts of granulating medium to oily waste on a dewatered waste basis are from 0.1 to about 10 parts added granulating medium per one part waste, more preferably from 0.3 to about 3.0 parts granulating medium per one part waste, and most preferably 0.5 to about 1.5 parts granulating medium per part waste.

Two tests have been devised to determine the extent of granulation: 1) an attrition index, which is defined as the weight percent of dried granules which pass through a 200 mesh screen during the attrition test procedure, and 2) a filtration rate index, which is defined as the rate at which a slurry mixture of dried granules and jet fuel is filtered using a filtration test procedure. According to the process of this invention oily waste/-granulating medium is mixed to form granules having an attrition index of less than about 10% and a filtration rate index of greater than about 0.20 gallons per minute per square foot. Preferably the attrition index will be less than about 5% and a filtration rate will be greater than about 0.5 gallons per minute per square foot. Most preferably the attrition index will be less than about 1% and a filtration rate will be greater than about 2 gallons per minute per square foot.

For the purposes of this application, an attrition index is defined as the weight percent of dried granules which pass through a 200 mesh screen, (sieve opening 0.074 millimeters), following an attrition test, the steps of which include:

drying 100 grams of granules in a vacuum chamber at 220° F. for 30 minutes;

b. combining the dried granules with one hundred and fifty (150), 3/16 inch diameter steel spheres onto a screening pan;

c. placing the screen pan containing the dried granules and the steel balls into a ROTAP for 10 minutes;

d. separating the steel balls from the granules of "c" above; and e. screening the product of "d" using a 200 mesh screen.

f. measuring the weight percent of dried granules which pass through a 200 mesh screen as a fraction of dried granules from step (a).

For the purpose of this application, a filtration index is defined as the rate at which a slurry mixture of dried granules and jet fuel is filtered per minute per square foot of filter area. the steps of which include:

a. drying 100 grams of granules in a vacuum chamber at 220° F. for 30 minutes, b. pressing the dried granules through a 32 mesh screen, and collecting the less than 32 mesh fraction of the dried granules, c. Using a 2 inch, 4 blade marine impeller with a pitch greater than or equal to about 30° and rotating at about 450 rpm, mixing the-32 mesh fraction in a slightly conical container (such as a 32 oz. malt cup), with jet fuel for 30 minutes to make a slurry containing about 20 wt. % solids.

d. filtering the slurry mixture using a 10 centimeter, No. 2 Whitman filter in a Buchner funnel, e. measuring the filtering rate expressed as gallons of jet fuel filtered per minute per square foot of filter area.

After the components have been granulated, excess water may be removed from the granules. This may be accomplished using heat over time.

After formation of the granules, the material is capable of being used in numerous processes known in the art, and may even be used in incinerators. According to a preferred embodiment of the present invention, the granules are contacted with a solvent to remove at least a portion of the contaminating hydrocarbons. Typically, the granules to solvent ratio is from about 0.1 to about 10.0, more preferably from about 1.0 to about 3.0. The number of contacts should be sufficient and of long enough duration to remove a portion of the hydrocarbon, more preferably at least 80% of the hydrocarbon from the granular mass, most preferably, at least 95%. Contact may be made in a vessel which allows agitation. Typical contact times are between 1 and 100 minutes and more typically between 2 and 30 minutes. One preferred method is to contact the granular mass with the solvent in a multistage countercurrent flow in which the granular mass travels in one direction and the solvent travels in another. After solvent extraction of the granular mass, the solvent may be separated from the granules by means known in the art, such as filtration. The solvent may then be separated from the extracted hydrocarbon and recycled or it may be used directly in a refining process such as feed to a crude unit.

The solvents useful in this extraction depend on the nature of the entrapped hydrocarbon. The solvent must be effective to dissolve the hydrocarbon. Preferable solvents include petroleum derived hydrocarbons, chlorinated solvents, tetrahydrofuran, methylethyl ketone, methyl isobutyl ketone, etc. Preferred petroleum derived hydrocarbons are fraction or distillates having a boiling range between 70° and 850° F.; more preferably between 180° and 650° F.; and most preferably between 275° and 550° F.

A mixture of solvents may be used to enhance the extract of the hydrocarbons. An advantageous co-solvent will improve the solubility of the oil (in the granulated waste) in the primary solvent. Specific examples of a cosolvent are: cresylic acid, tetrahydrofuran, and methyl isobutyl ketone.

After recovery of the granules from the solvent or mixture of solvents some solvent may still remain in the granules. The extracted granules may be heated or dried to remove residual solvents. The solvents that are removed during this step, may be recaptured and recycled or disposed in the same fashion as the bulk of the solvents. After solvent removal, the solids contain a reduced amount of contaminating hydrocarbons and may be used for other purposes or disposed of in an environmentally acceptable manner.

The examples are set forth for purposes of illustration only and are not meant to limit the invention to any theories, but instead is limited to what is claimed herein. Many variations and modifications thereof will be apparent to those of ordinary skill in the art and can be made without departing from. the spirit and scope of the invention herein described.

Analysis Via Modified Oven Drying Technique (MODT)

The MODT procedure was used to analyze the results in some of the experiments. This procedure determines the amount of light hydrocarbons, oil, water, and solids in oily waste. Light hydrocarbons are all hydrocarbons which volatilize when heated to 230°-240° F. for 2-4 hours. "Oil" is defined as those hydrocarbons which are soluble in dichloromethane and do not dissolve in water. "Solid" is defined as material which does not decompose at 250°-300° F. and is not soluble in dichloromethane.

The MODT is a two-stage procedure. In the first stage light hydrocarbons and water are separated from heavy oils and solids by heating in vacuum and by the use of nitrogen as stripper gas. Light hydrocarbons and water are recovered in cold traps and subsequently separated by freezing out the water phase. In the second stage, oils are separated from the solids by Soxhlet extraction with dichloromethane.

EXAMPLES 1-5

A granulating mixture was prepared by mixing limestone powder with Plaster of Paris in a 10:1 weight ratio.

A sample of refinery mid-layer emulsion centrifuge cake sludge was obtained as the feed for each example. This sludge feed consisted of 20-30 wt % feed solids, 15-25 wt % oil, and 50-60 wt % water.

Granules were prepared by mixing the granulating mixture and the sludge feed at the feed rates shown in Table I. The feed was discharged into a Turbulizer mixer (Model TCJS-8), manufactured by BEPEX Corporation of Minneapolis, Minn. The Turbulizer, a high speed, continuous mixer, consists of a horizontal cylindrical mixing chamber with a shaft containing paddles for mixing. The degree of mixing is controlled by changing the number and pitch of the paddles, and by changing the shaft speed (RPM). The residence time was typically from about 2 to about 30 seconds. The results are shown in Table I.

Table I also shows the results of the filtration tests from the batch runs using the sludge feed. The results show that a lower granulating mixture/sludge feed rate ratio resulted in a lower filtration rate (more fines). A lower mixing rate also resulted in a lower filtration rate. The attrition data shows that approximately 7% of the sample was −200 mesh (<0.074 mm).

TABLE I

| Example No. | Results from Example 1 | | | | | |
|---|---|---|---|---|---|---|
| | 1 | 2 | 3 | 4 | 5 | Note |
| Granulating Mixture Feed Rate, lbs/hr | 225 | 102 | 115 | 85 | 70 | |
| Sludge Feed Rate, lbs/hr | 85 | 85 | 85 | 85 | 70 | |
| Rotor RPM | 600 | 600 | 600 | 400 | 500 | |
| paddles | 40 | 40 | 23 | 21 | 21 | |
| Paddle setting | 20 @ +45°<br>20 @ 0° | 17 @ +45°<br>6 @ 0° | 17 @ +45°<br>6 @ 0° | 19 @ +45°<br>2 @ 0° | 19 @ +45°<br>2 @ 0° | (1)<br>(2) |
| Wt. loss on drying, % | 12.5 | 21.0 | — | 26.6 | 27.0 | |
| Attrition (−200 Mesh) | 6.0 | 7.7 | 6.6 | 4.0 | 7.6 | |
| Filtration Rate, (GPM/ft$^2$) | 0.93 | — | 1.27 | 0.33 | 0.67 | |

(1) Paddle faces at 45° forward pitch.
(2) Paddle faces parallel to rotor shaft

Approximately 100 grams of granules from each test was dried in an oven at 220° F. with 2 in. of water vacuum for 30 minutes. One hundred and fifty, 3/16 in stainless steel balls were added to the dried sample and placed in a screening pan. The screening pan, containing the sample and steel balls, was placed in a "ROTAP" for 10 minutes. Using a 7 mesh screen, the steel balls were separated and the sample was screened using a 200 mesh screen.

For the filtration rate test, 100 g of wet granulates were dried in an oven at 220° F. with 2 inches of water vacuum. The dried sample was pressed through a 32 mesh (<0.5 ram) screen. A 20 wt % solids slurry was prepared by mixing the −32 mesh (<0.5 mm) material with jet fuel for 30 minutes. The slurry was filtered using a No. 2 Whitman filter in a Buchner funnel, and the filtration rate measured.

EXAMPLES 6–8

Example 1 was repeated using a soil feed containing 8.3 wt % water, 7.0 wt % solvent (jet fuel A-50), 3.5 wt % oil, and 81.2 wt % solids. The size distribution and composition of the soil feed was as shown below:

| Size, (microns) | Cumulative wt % |
|---|---|
| 149 | 65.6 |
| 75 | 85.2 |
| 49 | 90.5 |

The soil feed was combined with the granulating mixture described in Example 1, and fed to the Turbulizer agglomerator. The results are listed in Table II.

TABLE II

| Example No. | Results from Examples 6–8 | | |
|---|---|---|---|
| | 6 | 7 | 8 |
| Granulating Mixture lbs/hr. | 170 | 35 | 109 |
| Soil Feed (−16 mesh portion), lbs/hr. | 156 | 168 | 156 |
| Rotor RPM | 500 | 850 | 500 |
| Wt. loss on drying, % | 8.0 | 9.2 | 7.9 |
| Attrition −200 mesh | 2.2 | 1.5 | 3.0 |
| Filtration Rate, GPM/ft$^2$ | 1.92 | 1.4 | 0.90 |

EXAMPLES 9–11

These examples demonstrates the effectiveness of hydrocarbon removal from the granules formed in accordance with the present invention. Sludges and a soil burdened with a hydrocarbon were combined with the granulating mixture described in Example 1, and fed to the Turbulizer agglomerator and granulated under conditions shown in Table III. Oil content of the feeds and resulting granules was determined by using the MODT method as described above. The granules were dried to 180° F. prior to extracting the hydrocarbon and then contacted with a solvent to remove the hydrocarbon. The results of the tests are listed in Table III below:

TABLE III

| Example No. | Results from Examples 9–11 | | |
|---|---|---|---|
| | 9 | 10 | 11 |
| Feed | Dewatered Sludge | Dewatered Sludge | Soil |
| solids | 23.2 | 25.4 | 81.2 |
| water | 54.5 | 56.7 | 8.3 |
| oil | 22.3 | 17.9 | 6.5 |
| Feed Rate | 100 | 100 | 100 |

TABLE III-continued

| Results from Examples 9-11 | | | |
|---|---|---|---|
| Example No. | 9 | 10 | 11 |
| (lbs./hr.) | | | |
| Granulating Mixture (lbs./hr.) | 180 | 120 | 63 |
| Oil in Dried Granules (wt. %) | 6.3 | 9.0 | 1.6 |
| Residual Oil in Granules (wt. %) | 0.22 | 0.15 | 0.12 |

What is claimed is:

1. A method for treating oily wastes burdened by one or more contaminating hydrocarbons wherein the oily waste is formed into granules, said method comprises:

a. mixing the oily waste with a granulating medium under turbulent flow conditions, wherein granules are formed having an attrition index of less than about 10 percent and a filtration index of greater than 0.20 gallons per minute per square foot.

2. The method of claim 1, further comprising:

b. contacting the granules with a solvent capable of dissolving at least a portion of the contaminating hydrocarbon; and c. recovering said granules, wherein said granules have a reduced content of contaminating hydrocarbons.

3. A method according to claim 1, wherein said granules are less than about 0.5 millimeters in size.

4. A method according to claim 1, wherein said granulating medium comprises a filler and a binder.

5. A method according to claim 4, wherein the ratio of binder to filler is from about 1:1 to about 1:100.

6. A method according to claim 5, wherein the ratio of binder to filler is from about 1:10 to about 1:5.

7. A method according to claim 4, wherein said filler is selected from the group consisting of fly ash, lindestone, spent catalysts and catalyst fines, calcium sulfate dehydrate, gypsum, calcium carbonate, and magnesium carbonate and said binder is selected from the group consisting of lime, portland cement, calcium aluminate, Plaster of Paris and gypsum.

8. A method according to claim 7, wherein said filler comprises limestone and said binder comprises portland cement.

9. A method according to claim 1, wherein the ratio of granulating medium to oily waste ranges from 0.1 to about 10:1.

10. A method according to claim 1, wherein the ratio of granulating medium to oily waste ranges from 0.3 to about 3:1.

11. A method according to claim 1, wherein said granules are formed by mixing the oily waste and granulating medium using a Turbulizer ® mixer.

12. A process according to claim 1, further comprising dewatering said oily waste prior to mixing the waste with said granulating medium.

13. The method of claim 1, wherein said granules have an attrition index of less than about 5 percent.

14. The method of claim 2, wherein the granules to solvent ratio is from about 0.1 to about 10.

15. The method of claim 14, wherein the granules to solvent ratio is from about 0.1 to about 10.

16. A method for treating oily wastes burdened by one or more contaminating hydrocarbons wherein the oily waste is formed into granules, said method comprises:

a. removing free liquids from the oily waste;

b. mixing the oily waste with a granulating medium comprising a filler and a binder in a Turbulizer ® mixer and under turbulent flow conditions, wherein granules are formed having an attrition index of less than about 10 percent and a filtration index of greater than 0.20 gallons per minute per square foot;

c. contacting the granules with a solvent capable of dissolving at least a portion of the contaminating hydrocarbon; and d. recovering said granules, wherein said granules have a reduced content of contaminating hydrocarbons.

17. A method according to claim 16, wherein the ratio of granulating medium to oily waste ranges from 0.1 to about 10:1.

18. A method according to claim 17, wherein the ratio of granulating medium to oily waste ranges from 0.3 to about 3:1.

* * * * *